US012728326B2

(12) United States Patent
Filippini

(10) Patent No.: US 12,728,326 B2
(45) Date of Patent: Sep. 8, 2026

(54) PICKLEBALL PADDLE AND METHOD

(71) Applicant: Gearbox, Inc., San Diego, CA (US)

(72) Inventor: Rafael G. Filippini, San Diego, CA (US)

(73) Assignee: GEARBOX, INC., San Diego, CA (US)

( * ) Notice: Subject to any disclaimer, the term of this patent is extended or adjusted under 35 U.S.C. 154(b) by 487 days.

(21) Appl. No.: 18/218,533

(22) Filed: Jul. 5, 2023

(65) Prior Publication Data

US 2024/0066371 A1 Feb. 29, 2024

Related U.S. Application Data

(60) Provisional application No. 63/401,803, filed on Aug. 29, 2022.

(51) Int. Cl.

| | |
|---|---|
| ***A63B 59/42*** | (2015.01) |
| ***A63B 59/40*** | (2015.01) |
| ***A63B 59/45*** | (2015.01) |

(52) U.S. Cl.
CPC ..... *A63B 59/42* (2015.10); *A63B 59/40* (2015.10); *A63B 59/45* (2015.10); *A63B 2209/00* (2013.01)

(58) Field of Classification Search
CPC ..... A63B 59/40; A63B 59/42; A63B 59/45; A63B 2102/08; A63B 2209/00
See application file for complete search history.

(56) References Cited

U.S. PATENT DOCUMENTS

2021/0252356 A1* 8/2021 Thurman ..... A63B 59/42

FOREIGN PATENT DOCUMENTS

| | | | | |
|---|---|---|---|---|
| CN | 114272579 A | * | 4/2022 | |
| CN | 117531180 A | * | 2/2024 | ..... A63B 59/42 |
| WO | WO-2022217045 A1 | * | 10/2022 | ..... A63B 59/42 |

* cited by examiner

*Primary Examiner* — Audrey B. Walter
(74) *Attorney, Agent, or Firm* — Procopio, Cory, Hargreaves & Savitch LLP

(57) ABSTRACT

A composite molded sports paddle comprising a head with a hitting surface; a throat; and a handle, wherein the hitting surface includes a molded textured area.

6 Claims, 3 Drawing Sheets

PICKLEBALL PADDLE AND METHOD

FIELD OF THE INVENTION

The subject matter discussed herein relates generally to composite molded sports paddles and particularly to composite molded pickleball paddles.

BACKGROUND

Sports paddles of today are generally comprised of composite materials including fibrous unidirectional or woven fibers impregnated with thermal set resins that make up the outer surface plies and handle area, while the hitting internal surface area is generally constructed of a honeycomb plastic material. Generally, honeycomb structure paddles are a sandwich structure with several layers of fibrous materials which are glued to the honeycomb core to create a large single sandwich structure sheet. Paddle shapes are then laid out onto the panel or sheet to yield the highest number of paddles within the honeycomb panel. Further, honeycomb structures have tremendous limitation in performance, durability, bending, torsional moments and esthetics due to its homogenous structure and open cells exposure when the panel is cut.

Traditionally, the frame of sports paddles were made of wood. More recently, paddles have been made from aluminum core, foam cores, honeycomb core, and composite materials. In a more traditional wood or aluminum structure, the paddle is made entirely using these materials, which are cut to the desired finished shape. To complete the paddle a handle is then built up using additional wood, aluminum, or other materials to increase the circumference of the handle. This process limits the weight to strength ratios as well as the ability to customize weight, balance, and the like. Traditional paddles are made of solid wood, injected plastics, or composite fiber with honeycomb cores. All of these paddles structures have tremendous disadvantages due to the construction methods and the limits due to the materials and technology. The paddles of today rely on these homogeneous structures that limit the weight distribution and overall weight, leaving them with limited performance characteristics. Further, the more advanced paddles with honeycomb cores are also limited due to how the panel is cut, which leaves the core edges exposed with a gap between the top and bottom surface plies. The gap allows for easy destruction of the paddle, so a plastic cover is normally added around the edges creating a step around the edges which result in a non-uniform hitting surface. As a result, if the ball strikes near the edge, it will change direction. Yet another problem with the paddles of today is the handle. The handle is also a buildup of different materials from the surface and requires additional processing to complete. The appearance is a non-esthetic assembly of various pieces. Yet another problem with solid sports paddle construction is the sound produced at impact. The core is usually made of an entirely rigid material giving out loud sounds on impact. Cores or other dampening materials are not added due to the weight restrictions or difficulty to manufacture.

Solid face hitting areas are often made from wood and aluminum alloy materials. Due to the ease of manufacturing these structures, solid wood or aluminum structures have been used to produce low price, low technological, and mass-production paddles. These solid face structures have many limitations, mostly due to the materials and limited use of these materials. The frame and solid face structures cannot be manipulated to increase strength, stiffness, or change the shape of said structures. Additionally, wood, aluminum, and honeycomb composite structures are heavy and lack strength.

In recent years, composite frame and face structures are used in paddle manufacture, mostly of the higher strength-to-weight ratio in composite paddle frame and face construction. Combinations of materials such as carbon, aramid fiber, fiberglass, boron, and other fibrous material have been used to manufacture sports paddles. This can produce paddles that are more rigid, lighter, and larger, thus improving the player's ability and advancing the evolution of each individual sport.

Paddle frames of composite paddles are sometimes produced by bladder molding where a structure is created by using compressed air, chemical reactions to increase pressure, or hot gasses to apply internal pressure within the structure, thus forcing the material to the predetermined edges of the rigid mold shape. At this time, when pressure is added to the structure, the mold and the part is heated to a temperature which that accelerated the catalyst process to harden the structure. Once hardened, usually using thermal set resins, a rough paddle frame structure is created.

When producing paddles utilizing bladder molded internally pressurized molded techniques, the shape of the frame or paddle can be more efficiently controlled in both in length, width, and depth. The shape does not have to be uniform through the paddle and the shape can vary or even be interrupted to help provide improved bending and torsional moments. When producing fibrous structures varying the angle of the plies does provide tremendous variations in bending and torsional stiffness throughout the frame shape, however adding a mechanical shape change along with the fiber angles will help provide more precise and a larger range of manipulation for flex and torsion of the paddle.

Players traditionally have focused more on power and control, however, as players skills continuously improve, the combination of power and control do not suffice. Spin has become an equally important feature to power and control for paddles to have as part of their play characteristic. Players are demanding spin, touch, durability, more power, and control from the paddles being produced.

SUMMARY

An aspect of the present disclosure involves a sports paddle with a hitting surface wherein a skin of the surface is applied and varied during the molding process to improve manipulation of ball spin at impact of the ball and paddle, producing beneficiary outcomes depending on the style of play of the individual striking the ball. The level of surface texture can be manipulated to remain permanently adhered to or have a removable texture face to provide various levels of texture as desired.

Another aspect of the invention involves composite sport paddle having opposed outer surfaces and a core comprising a plurality of ribs or a honeycomb panel connecting between and connected to the outer walls, frame structure and handle. The outer panel surfaces, the frame structure, handle, and internal chamber walls or ribs are made of a woven or non-woven fibrous material, or a honeycomb core structure may be used to fill the internal hitting surface. The section connecting the head portion (hitting area) is connected to a handle, this transition area between the handle and head portion is particularly important in the sports of pickleball as it helps determine the dwell time the ball will have with the paddle at impact and thus becoming important to feel, control, power, and spin or the ball during and after striking the ball. Further, having the ability to apply textured membranes, pre-molded or semi cured carbon fiber plies with textured surfaces, during the molding process, is particularly advantageous when creating a cavity molded pickleball paddle. Pickleball's rules governing body USA Pickleball (USAP) has a particular set of limitations that control the levels of deflection of the striking surface, texture, and friction and thus limiting the trampoline effect, spin, and drag coefficient of the ball against the surface of the paddles striking surface. So, by controlling the dwell time between the paddles head and handle transition and having the ability to add pre-determined surface finish during the molding process, then the effective "spring rate of the paddle" and drag coefficient to control ball spin rates as well ball control and ball velocity can be manipulated, thus creating an advantage for those practicing in the sport of pickleball.

An additional aspect of the present disclosure involves utilizing the molded bladder techniques and manipulating the hitting surface, the region between the hitting surface, and manipulating the handle area to further increase or reduce dwell time between the ball and paddle to the necessary outcomes demanded by today's players.

Another aspect of the disclosure involves a composite internally pressurized molded paddle, or a compression molding method, or combination of compression with internal pressure can be used to create and shape paddles. Further, during the molding process an outer cured or semi cured layer can be adhered to the surface to create variable surface textures, patterns, to manipulate friction levels to improve drag coefficient between the paddles surface and ball. The manipulation of surface texture or roughness and the combination of paddle stiffness and bending are directly proportional to ball exit velocity, increased dwell time for control, and improved ball spin. In this case, various skin textures are applied during the molding process, to manipulate outer surface texture or roughness to control drag coefficient between the ball and paddle surface.

Another aspect of the disclosure involves application of surface skins or variable roughness to the paddle during the cavity molding process. Having the ability to apply cured or semi cured textured skins during the molding process of pickleball paddle has tremendous advantages as the level of texture applied to the finished paddle can be controlled with a permanently attached surface to the paddle face. Attaching the skin to the base paddle structure allow those in the art to create a structure independent to the surface texture then choose the level of drag coefficient on the paddle face. Another advantage in molding the semi cured or cured surface skin to the paddle during the molding step, allows variable surfaces to be applied to the paddles surface meaning side A can have a surface with a predetermined roughness while side B have a secondary surface roughness. Further yet, variable surface textures can be applied on a single side of the paddle's face and thus have progressive drag coefficients on a single side of the paddle's striking surface.

An additional aspect of the disclosure involves a recessed area on the molded paddles side A and side B to receive a pre-cured and textured skin. Creating a cavity on the paddles face to receive a cured textured face with a predetermined shape is an advantage. One advantage to a applicable textured surface is a worn texture can be removed and replaced with a new texture without having to replace the entire paddle. Second advantage, varying textures to each side of the paddle can be applied where side A can have a light texture while side B has a more robust texture to maximize spin and thus providing a player increased number of shots. Lastly, having the ability to replace the paddles surface extends the paddles life and thus provides consumers higher value.

Another aspect of the invention involves a composite molded sports paddle comprising a head with a hitting surface; a throat; and a handle, wherein the hitting surface includes a molded textured area.

One or more implementations of the aspect of the invention described immediately above includes one or more of the following: the composite molded sports paddle is a composite molded pickleball paddle; the composite molded sports paddle is one of a composite internally pressurized molded sports paddle, a composite compression molded sports paddle, and a combination compression with internal pressure molded sports paddle; the hitting surface is an outer cured layer adhered to the head or semi cured layer adhered to the head; the hitting surface is an outer cured skin molded to and with the head or a semi cured skin molded to and with the head; the head includes opposite sides with respective hitting surfaces having one or more of different textures, different friction, different roughness, different variable roughness, different variable surface textures, different patterns, different drag coefficients; the hitting surface includes a variable surface texture; the hitting surface includes progressive drag coefficients; the hitting surface is a removable and replaceable textured face that is removably attachable to the head; and/or the head includes a cavity that receives the removable and replaceable textured face.

Another aspect of the invention involves a method of using a composite molded sports paddle comprising a composite molded sports paddle including a head with a hitting surface; a throat; and a handle, wherein the hitting surface includes a molded textured area, the method comprising hitting a ball with the molded textured area of the hitting surface, improving drag coefficient between the hitting surface and the ball.

One or more implementations of the aspect of the invention described immediately above includes one or more of the following: the head includes opposite sides with respective hitting surfaces, and the respective hitting surfaces having one or more of different textures for the hitting surfaces of each side and different texture areas within the hitting surface of the side, and hitting includes hitting the ball with different textures to control drag coefficient between the hitting surface and the ball; the hitting surface is a removable and replaceable textured face that is removably attachable to the head, and the method further comprising removing the textured face from the head; replacing the textured face with a replacement textured face; attaching the replacement textured face to the head; the head includes a cavity that receives the removable and replaceable textured face, and the method further comprising removing the textured face from the cavity of the head; attaching the replacement textured face within the cavity of the head.

A further aspect of the invention involves a method of manufacturing a composite molded sports paddle comprising a composite molded sports paddle including a head with a hitting surface; a throat; and a handle, wherein the hitting surface includes a molded textured area, the method comprising molding composite molded sports paddle; during molding of the composite molded sports paddle applying the molded textured area to the head.

One or more implementations of the aspect of the invention described immediately above includes one or more of the following: during molding includes during molding of the composite molded sports paddle applying various skin textures to the head; the head includes opposite sides and applying various skin textures includes at least one of applying different skin textures to a side and applying different skin textures to the opposite sides; molding the composite molded sports paddle includes one of internal pressurized molding the composite molded sports paddle, composite compression molding the composite molded sports paddle, and combined compression with internal pressure molding the composite molded sports paddle; applying the molded textured area includes adhering an outer cured layer to the head or adhering a semi cured layer to the head; and/or applying the molded textured area includes molding an outer cured skin to and with the head or molding a semi cured skin molded to and with the head.

BRIEF DESCRIPTION OF DRAWINGS

The accompanying drawings, which are incorporated in and form a part of this specification illustrate embodiments of the invention and together with the description, serve to explain the principles of the invention.

DESCRIPTION OF EMBODIMENT OF THE INVENTION

Figure 1A:
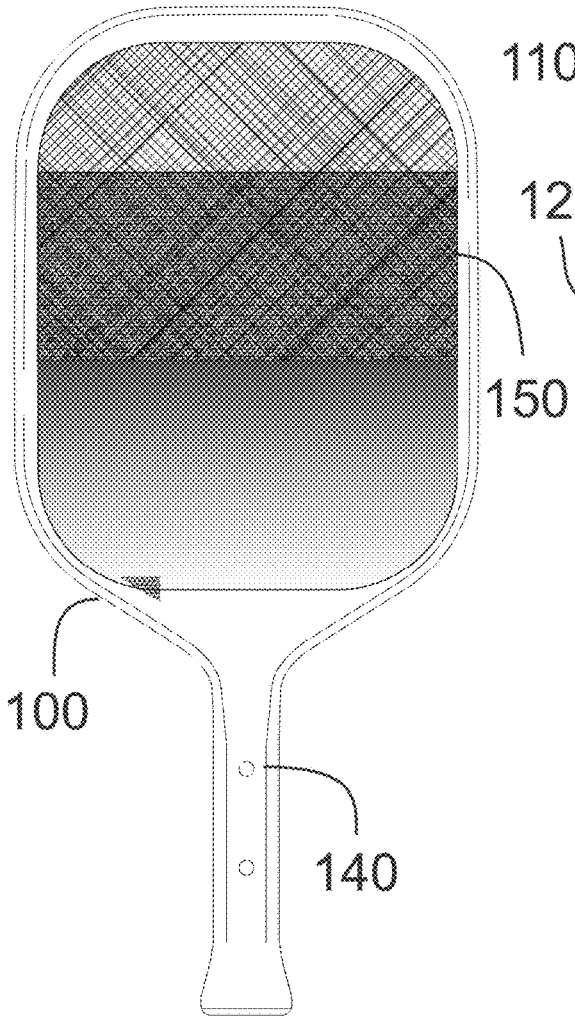
FIGS. 1A-1B are a front elevational view and a rear elevational view of an embodiment of a paddle including a molded texture area.
Figure 1B:
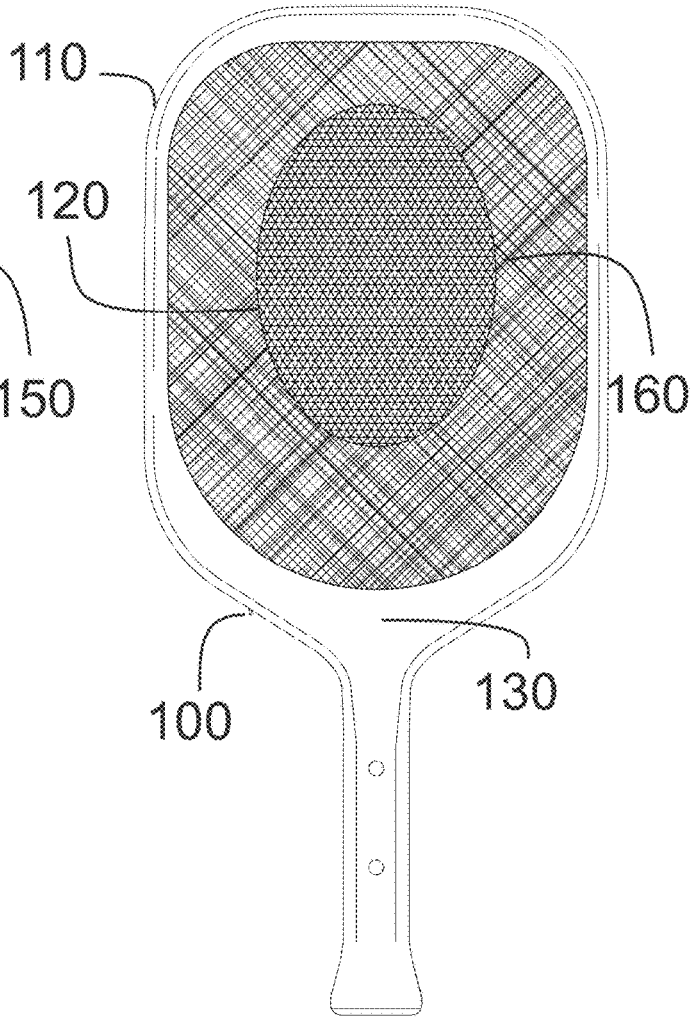

With reference to FIGS. 1A-3B, an embodiment of a composite internally pressurized molded paddle 100, or a compression molding method, or combination of compression with internal pressure can be used to create and shape paddles, will be described.

The paddle 100 is created and shaped by an internally pressurized molded method, or a compression molding method, or combination of compression with internal pressure. The paddle 100 includes a head 110 with a hitting surface 120, a throat 130, and a handle 140. The hitting surface 120 is a molded textured area.

During the paddle molding process an outer cured or semi cured layer is adhered to a surface of the head 110 to create variable surface textures 150, 160 (FIGS. 1A-1B), patterns 170, 180 (FIGS. 2A-2B) to manipulate friction levels to improve drag coefficient between the hitting surface 120 and ball. The manipulation of surface texture or roughness and the combination of paddle stiffness and bending are directly proportional to ball exit velocity, increased dwell time for control, and improved ball spin. In this case various skin textures are applied during the molding process, to manipulate outer surface texture or roughness to control drag coefficient between the ball and hitting surface 120.

Another aspect of the disclosure involves application of surface skins or variable roughness to the paddle 100 during the cavity molding process. Having the ability to apply cured or semi cured textured skins during the molding process of pickleball paddle 100 has tremendous advantages as the level of texture applied to the finished paddle 100 with a permanently attached surface 120 to the paddle face can be controlled. Attaching the skin to the base paddle structure allow those in the art to create a structure independent to the surface texture then choose the level of drag coefficient on the paddle face. Another advantage in molding the semi cured or cured surface skin to the paddle during the molding step, allows the application of variable textures to the surface 160 so that, for example, side A can have a surface with a predetermined roughness while side B have a secondary surface roughness. Variable surface textures 150, 160 such as those shown in FIGS. 1A-B may be applied on a single side or surface 120 and, thus, have progressive drag coefficients on the single side or the surface 120.

Figure 2A:
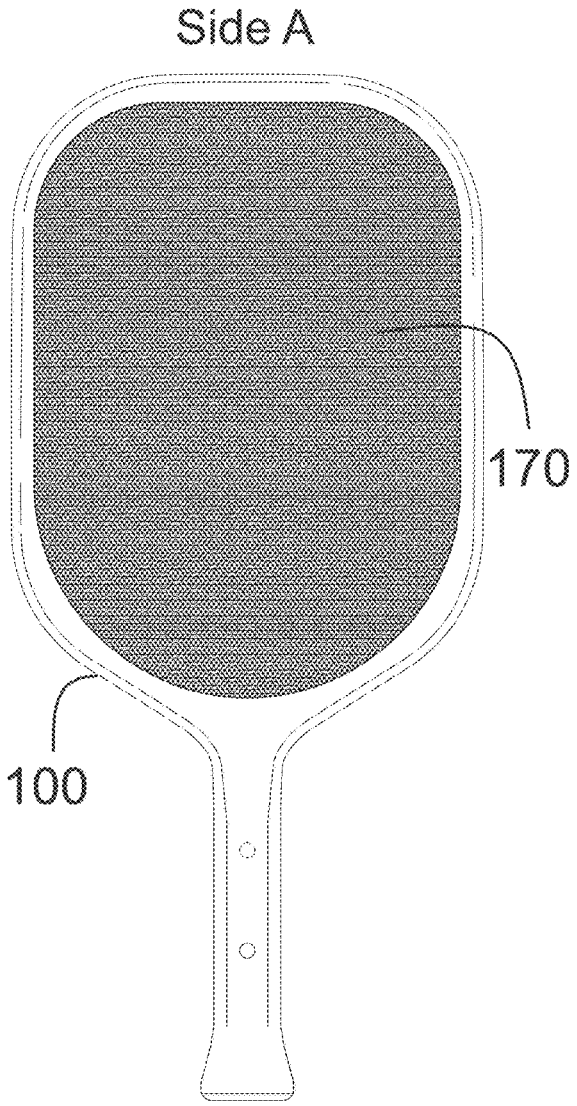
FIGS. 2A-2B are a front elevational view of a Side A of a paddle and including a molded texture area and a rear elevational view of a Side B of the paddle and including a molded texture area that is different than the molded texture area of Side A.
Figure 2B:
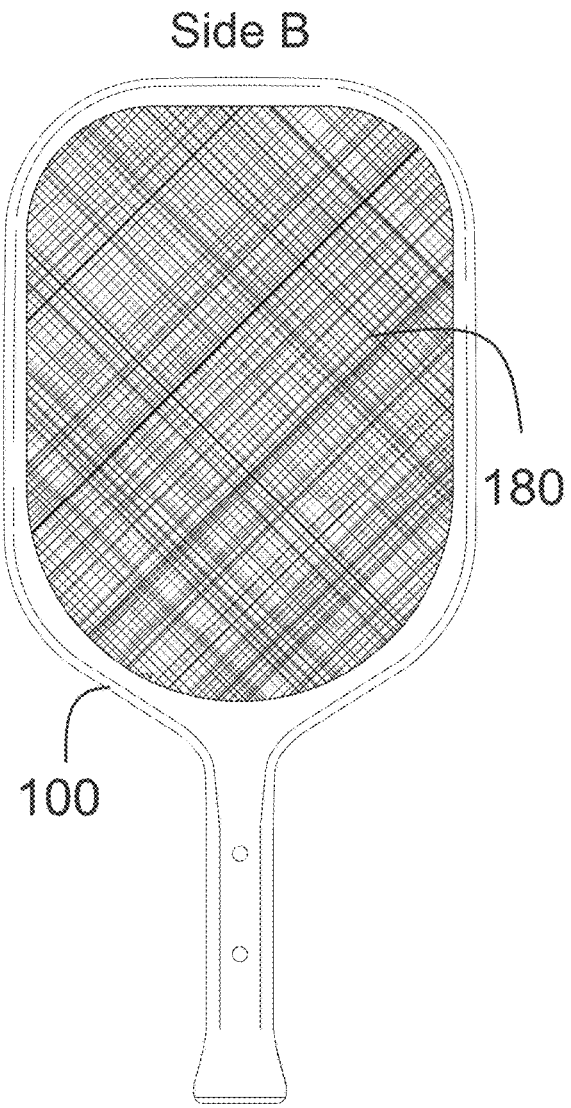
Figure 3A:
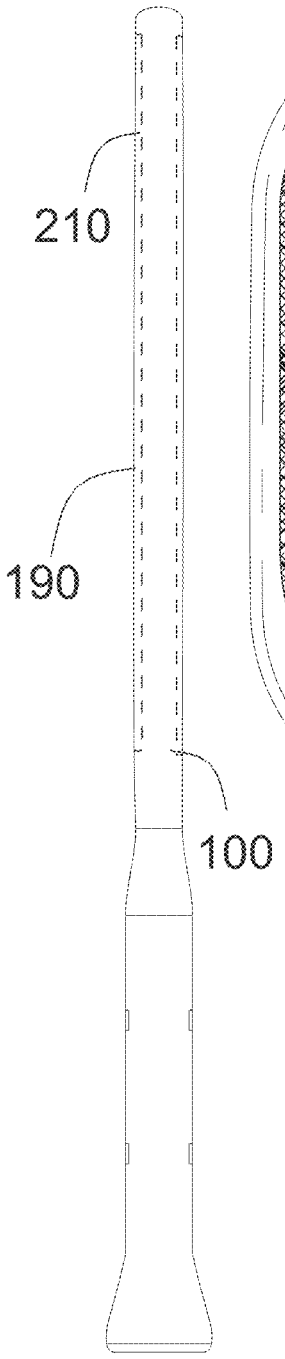
FIGS. 3A-3B are a side elevational view and a rear elevational view of a Side B of a paddle including a recessed area on opposite molded paddles side to receive a pre-cured and textured removable/replaceable face/skin.
Figure 3B:
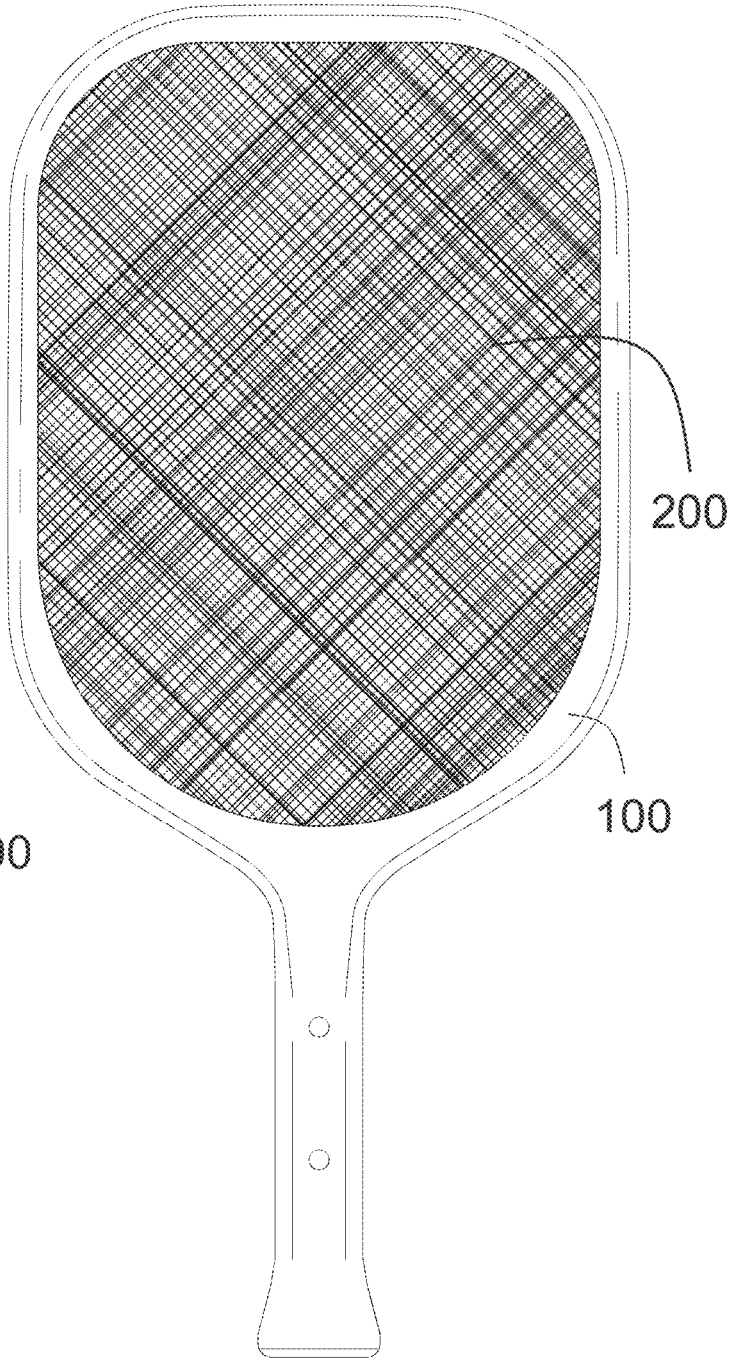

With reference to FIGS. 3A-3B, an additional aspect of the disclosure involves a recessed area 190 on the molded paddles side A and side B to receive a pre-cured and textured skin 200. Creating a cavity on paddle face 210 to receive a cured textured face/skin 200 with a predetermined shape is an advantage. One advantage to an applicable textured surface face/skin 200 is that the worn textured face/skin 200 may be removed and replaced with a new textured face/skin 200 without having to replace the entire paddle 100. Another advantage is that varying texture faces/skins 200 may be applied to each side of the paddle where, as shown in FIGS. 2A-B, side A can have a light texture 170 while side B has a more robust texture 180 to maximize spin and thus providing a player increased number of shots. Lastly, having the ability to replace the paddles surface face/skin 200 extends the life of the paddle 100, and, thus, provides consumers higher value.

The figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus, the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

The invention claimed is:

1. A method of manufacturing a composite molded sports paddle head of a composite molded sports paddle comprising the head with a hitting surface; a throat; and a handle, the composite molded sports paddle head made of a sport paddle head composite material and an outer cured textured layer or a semi cured textured layer, comprising creating the composite molded sports paddle head by simultaneously molding the sport paddle head composite material and the outer cured textured layer or the semi cured textured layer into the composite molded sports paddle head in a single step whereby the outer cured textured layer or the semi cured layer is adhered to the sport paddle head composite material, wherein molding the composite molded sports paddle head includes one of internal pressurized molding the composite molded sports paddle and combined compression with internal pressure molding the composite molded sports paddle.

2. The method of manufacturing of claim 1, wherein the composite molded sports paddle is a composite molded pickleball paddle.

3. The method of manufacturing of claim 1, wherein the hitting surface includes a variable surface texture.

4. The method of manufacturing of claim 1, wherein the hitting surface includes progressive drag coefficients.

5. The method of manufacturing of claim 1, wherein simultaneously molding includes applying various skin textures to the head during molding of the composite molded sports paddle head.

6. The method of manufacturing of claim 5, wherein the composite molded sports paddle head includes opposite sides and applying various skin textures includes at least one of applying different skin textures to a side and applying different skin textures to an opposite side, the different skin textures including one or more of different friction, different roughness, different variable roughness, different variable surface textures, different patterns, and different drag coefficients.

* * * * *